United States Patent [19]

Hoyles

[11] 4,244,580

[45] Jan. 13, 1981

[54] MULTIVARIANT BOARD GAME APPARATUS

[76] Inventor: Francis X. Hoyles, 6410 Morris Park Rd., Philadelphia, Pa. 19151

[21] Appl. No.: 45,417

[22] Filed: Jun. 4, 1979

[51] Int. Cl.[3] ..... A63F 3/00

[52] U.S. Cl. ..... 273/272; 273/248; 273/284; 273/282

[58] Field of Search ..... 273/282, 284, 239, 140, 273/265, 272

[56] References Cited

U.S. PATENT DOCUMENTS

| | | | |
|---|---|---|---|
| 464,391 | 12/1891 | Samuels | 273/140 |
| 606,744 | 7/1898 | St. John | 273/236 |
| 1,553,835 | 9/1925 | Peters | 273/282 |
| 2,219,546 | 10/1940 | Petersen | 273/282 |
| 2,757,934 | 1/1954 | Dunbar | 273/282 |
| 3,116,927 | 1/1964 | Kuhlman | 273/272 |
| 3,267,590 | 8/1966 | Browning | 273/282 |
| 3,495,831 | 2/1970 | Healy | 273/282 |
| 3,684,288 | 8/1972 | Grace | 273/239 |
| 3,744,153 | 7/1973 | Van Es | 273/282 |
| 3,844,563 | 10/1974 | Issac | 273/282 |
| 3,929,337 | 12/1975 | Hayes | 273/282 |
| 4,171,815 | 10/1979 | Startz | 273/284 |
| 4,194,742 | 3/1980 | Adams | 273/265 |

FOREIGN PATENT DOCUMENTS

| | | | |
|---|---|---|---|
| 567020 | 1/1945 | United Kingdom | 273/246 |

*Primary Examiner*—Richard C. Pinkham
*Assistant Examiner*—R. Carl Moy
*Attorney, Agent, or Firm*—Arthur E. Oaks; Robert B. Famiglio; Robert S. Lipton

[57] ABSTRACT

A game board apparatus adapted to play a wide variety of optionally chosen games. The apparatus includes a game board having an elevated rectangular coordinate gridded playing area adapted to cooperate with various playing pieces and space limiters to create an almost infinite variety of playing patterns. The apparatus further includes playing pieces adapted to be used for playing word games, traveling games and the like and a random piece selector designed to increase the element of luck while still placing a premium on playing skill.

1 Claim, 12 Drawing Figures

MULTIVARIANT BOARD GAME APPARATUS

FIELD OF THE INVENTION

The present invention relates to a board game apparatus which can be adapted for the playing of a number of different games, all of which combine the attributes of skill and luck, by persons of varying ages.

BACKGROUND AND SUMMARY

There are today a large variety of board games of the type where the playing pieces are assembled into some type of pattern, such as words, during the play of the game. However, it has been found that the game apparatus is usually highly specific to one particular game and rarely is adaptable to other types of game situations. The present game apparatus is multivariant in that it has been designed to be adaptable to a large number of different game types and situations. Thus it provides means to limit the size of the actual playing surface on the board, to set up different playing paths or zones and to provide different methods for determining success during the game and, ultimately, victory at its conclusion. Furthermore, these changes are made by the players themselves so that each play of a particular game can be made more or less complex from preceding plays depending on how challenging the players want it to be. Furthermore, as presently configured, the game apparatus combines the attributes of both skill and luck. As a result it is capable of providing entertainment to players of all ages and educational backgrounds.

The game apparatus itself is fairly simple comprising as it does a basically square game board having a coordinate grid space system printed thereon as the playing surface, a large set of individual playing pieces with various symbols printed thereon and adapted to fit into said grid spaces so that various patterns may be formed and a system for randomly selecting the individual playing pieces used to construct these patterns during the play of a game.

In this sense it is similar to a number of other board games including the well known "Scrabble" and the systems recently patented by Shapiro, in U.S. Pat. No. 3,746,343 and Matsumoto in U.S. Pat. No. 4,083,564. However, it also has a number of unique features which serve to distinguish the present game apparatus from all of these. For one, the symbols on the playing pieces are not fixed, that is, they are not of one kind, such as with Scrabble. Rather, they are provided with a variety, including letters, numbers, playing card designations, and representation symbols such as arrows, animals and the like. Thus they form the basis of a wide variety of game situations which are established at the option of the players before a game starts. A second feature is the use of one or more area limiters adapted to alter the size and shape of the playing surface on the board and to create a variety of maze like playing paths on the board to limit the size and shape of the patterns which may be formed. These limiters also can be placed on the board in advance so that an almost infinite variety of game situations can be established in advance ranging from the very simple to quite complex. The actual ones chosen depend on the skill of the players and the challenges they wish to meet. Regardless of which type of symbols used, and playing path selected, the random nature of playing piece selection assures that skill alone will not "win" the game. Rather, a considerable portion of "good" luck will also be necessary for a player to meet his game objectives before one of the other players in the game does. By so doing players of all ages can play and enjoy the game.

Thus, the principal object of the invention is to provide a game apparatus adaptable to be adjusted into a variety of game situations at the option of the players of the invention.

It is a second objective of the invention to provide an apparatus in which the elements of skill and luck are combined in every game so that the players of all ages and backgrounds may play and enjoy it.

These and other objectives and features of the invention will become apparent from the following detailed description taken in conjunction with the accompanying drawings and appended claims.

BRIEF DESCRIPTION OF THE DRAWINGS

In the drawings, in which like numerals refer to like parts.

DESCRIPTION OF THE PREFERRED EMBODIMENT

Figure 1:
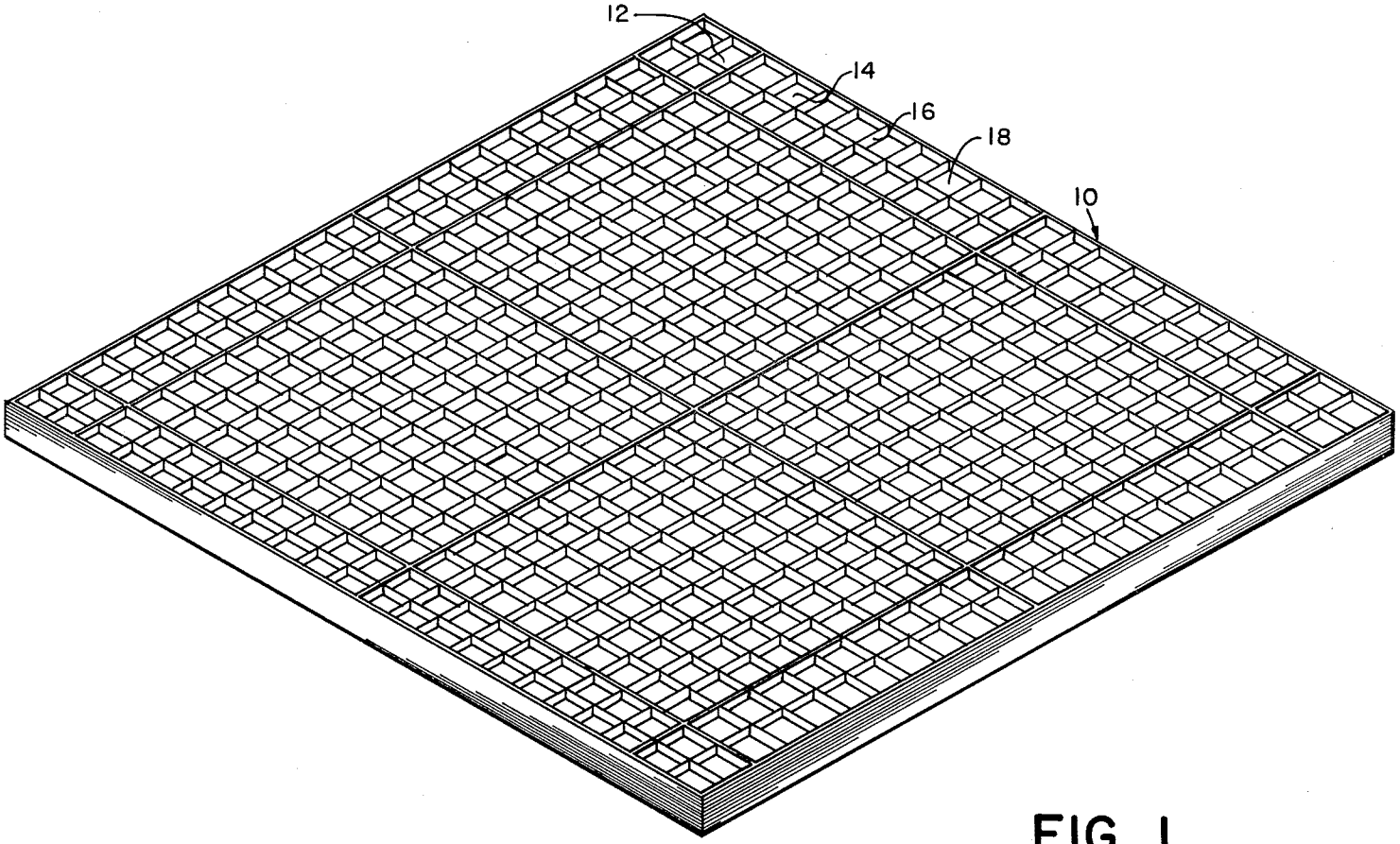
FIG. 1 is a perspective view of the basic game board of the present invention which is provided with a gridded partitioned playing surface printed thereon, on which the playing pieces move.
Figure 2:
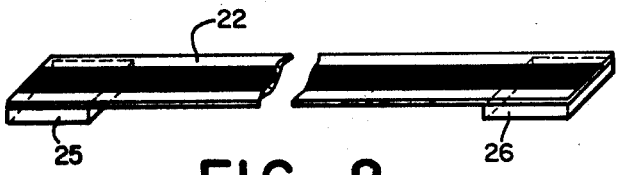
FIG. 2 is a perspective view of an area limiter which alters the arrangement of the playing paths on the game board.
Figure 6A:
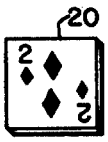
FIG. 6*a*, 6*b*, 6*c*, 6*d* and 6*e* show some playing pieces with some of the different symbols which can be printed on them.
Figure 6B:
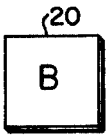
Figure 6C:
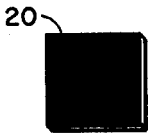
Figure 6D:
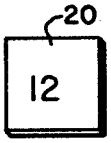
Figure 6E:
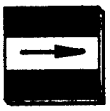
Figure 3:
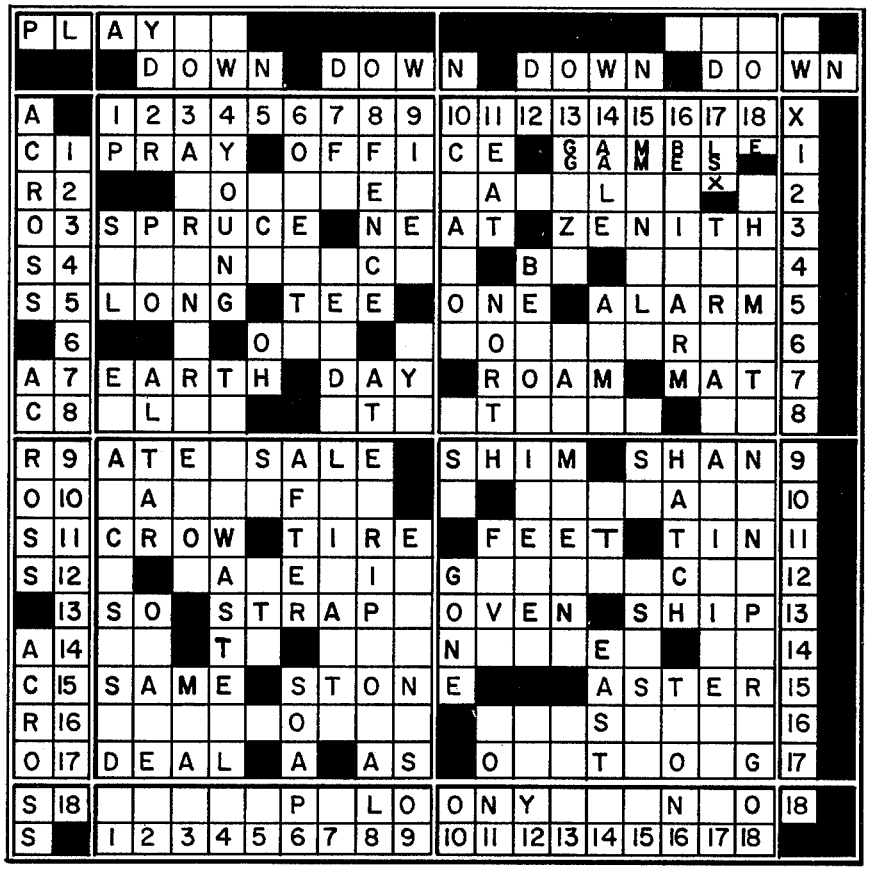
FIG. 3 is a view of one arrangement of the game board when area limiters are used to set up a word game on the board.
Figure 4:
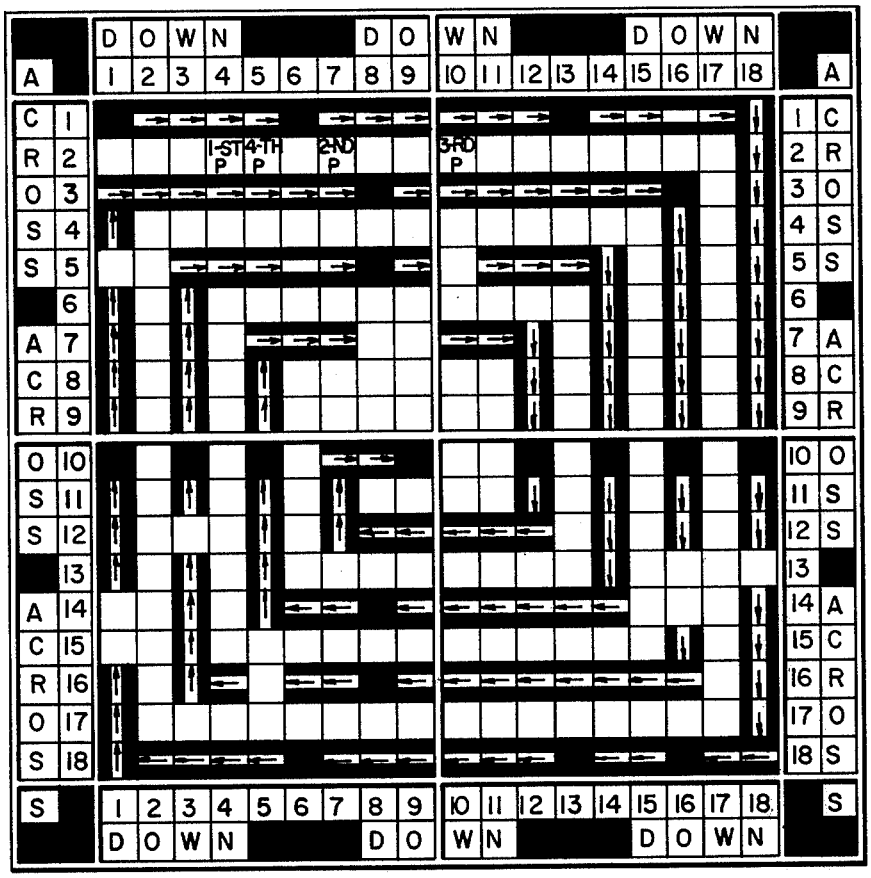
FIG. 4 shows one maze pattern set up with the area limiters on the board.
Figure 5:
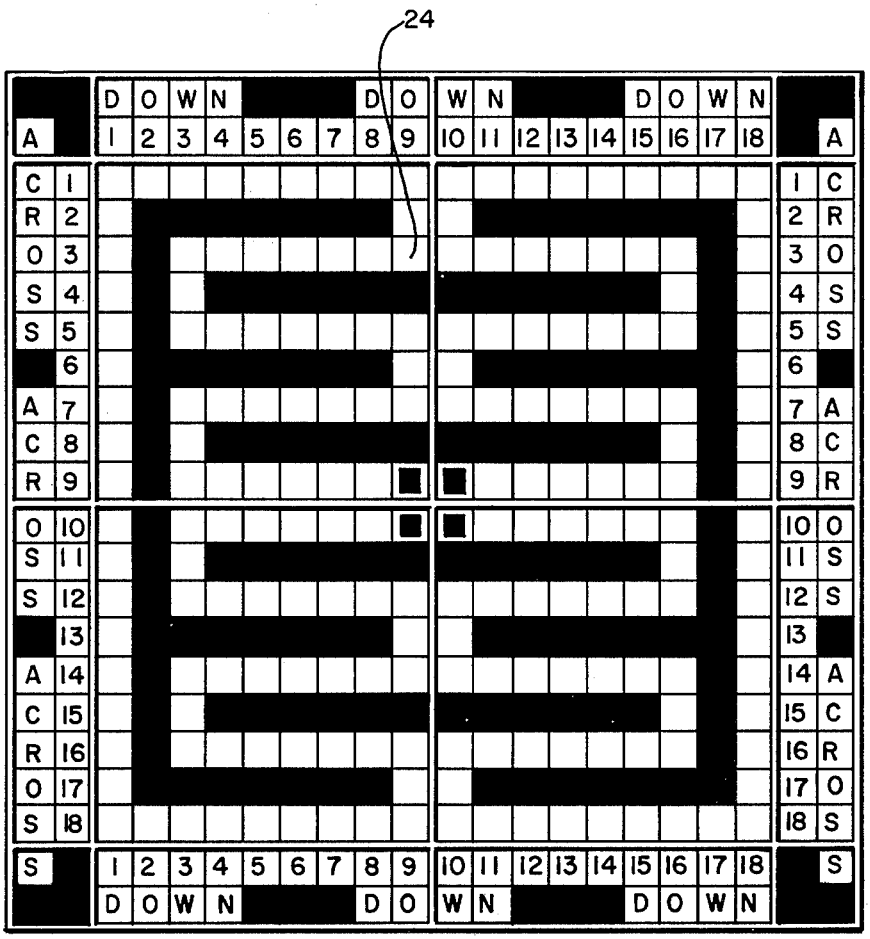
FIG. 5 shows another maze pattern on the board.

Referring now to FIG. 1 we see a perspective view of the game board 10 as used in the present invention. As shown the preferred embodiment is basically square so that it is adapted for use by from 2 to 4 players, although other shapes, such as rectangular, can be used to accomodate more players. Board 10 is provided with a playing surface 12 printed thereon which is divided into a rectangular coordinated grid system 14 having rows and columns and further defined by grid type webbing 16 which is placed over and secured to surface 10 such that said webbing extends along the sides of each grid space to separate surface 12 into a multiplicity of playing cavities 18. These cavities act to hold one of a set of playing pieces 20 fixing it in place so that it cannot slip or slide out of position. In addition they serve to hold one end of a limiting strip 22 which serves to block off portions of a row or column in surface 12 to form either a smaller playing area or to create mazes 24 of varying complexity to make the game more exciting or difficult. FIG. 2 shows a view of one of these strips. In the preferred embodiment there is no restriction on the length of these strips and the game apparatus will normally be provided with a plurality of these ranging in length from just one space up to the entire length of a row or column. The strips are made of plastic or aluminum and comprise a set of end lugs 25 which fit into one of the cavities 18 so as to lift body 26 over the top of webb 16 so that said body can extend some distance along a row or column to another cavity 18. Of course, if only one cavity is to be filled, the lugs and body merge into one piece but this is really a special case. FIGS. 3, 4, and 5 show some of the patterns which can be achieved with limiting strips 22. In FIG. 3 the board is divided into a crossword type arrangement for a word-type game which competing players can use against each other. FIGS. 4 and 5 show the strips 22 being used to define playing mazes of varying complexity. In these cases the defined area shown in FIG. 1 is further divided into playing paths along which the players traverse in "traveling" type games. The strips can also be used to create obstacles of one kind or another which effectively impede the rate of travel achievable by an "unlucky" player. FIG. 4 shows an arrow arrangement illustrating this factor.

The games themselves are played with a variety of playing pieces 20 some of which are shown in FIGS. *6a*, *6b*, *6c*, *6d*, and *6e*. These comprise the set of letters from a to z, numbers from the 52 symbols of a deck of cards and various representational symbols such as arrows, animals and dots. In the preferred embodiment, the game apparatus will contain 3 or 4 different sets, usually varicolored to distinguish those of one player from those of another. There will also be blank pieces so that the players can make up their own designs should they so choose.

Figure 7:
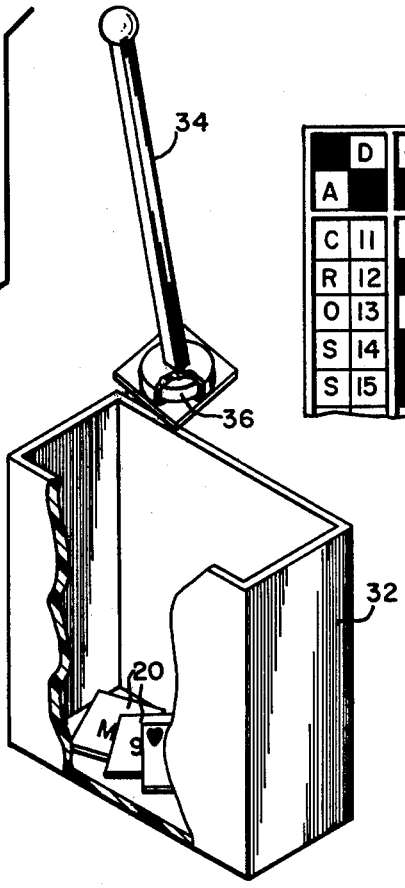
FIG. 7 is a cross-sectional view of the randomized playing piece selector used in the present invention.

A common feature in all of the games anticipated will be random selection of pieces 20. To achieve this, they are stored in an open topped container 32 usually in the form of a fairly deep cup or box. The pieces 20 are made of a very thin gage grade of magnetic carbon steel, such as AISI 1010, and, as previously noted, are of such size as to readily fit into one of cavities 18. Selection is made by a player inserting wand 34 having a small magnet 36 on the inserted end thereof, as shown in FIG. 7, to pick up one of the playing pieces 20 contained therein for use by a player. Occasionally, two pieces will be picked up and the rules can be adapted to allow the player to use both or pick just one.

Figure 8:
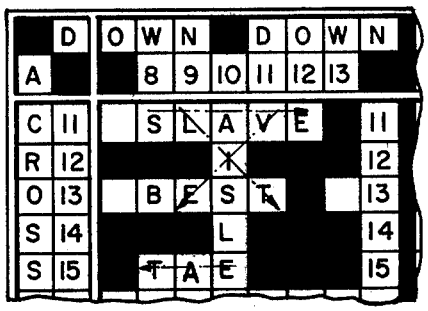
FIG. 8 is a view of a word game played with the present apparatus.

One type of game which it is anticipated will be the most widely played will be word games. Using the various components these can be either set up with obstacles in advance such as with crossword puzzles which put a premium on skill, or set up to insert obstacles during the play of the game which add a large element of luck to the play of the game. Since the rules are flexible the words can be spelled left to right, right to left, upwards, downwards or diagonally at the option of the players, FIG. 8 shows a partially completed work game employing some of these features.

Another game is a traveling game which is illustrated in FIG. 4. As shown here, a basically spiral pattern has been laid out using arrow type pieces to define the path. As this game is played a distinctively encoded piece 20 such as an animal or playing card is used as a playing token by each player, and passage down the path is controlled by a chance generating device, such as a die or spinner (not shown). It will be noted that the pieces defining the path have gaps in them at a number of locations and in the center of the spiral the path is two spaces wide. As played the pieces are moved along the path in turn according to the number of spaces indicated by the chance generating device. Where the path is only one space wide, landing on a space already occupied by another player's token allows the player to have yet another turn and advance further. Where the gaps or double width spaces occur the two tokens can rest side by side and no second turn is taken. Of course, the location and number of such spaces is entirely optional and can change from one play of the game to another. The first player to reach the end of the spiral wins the game.

Although the present invention has been described with reference to the particular embodiments hereinsetforth, it is understood that the present disclosure has been made only by way of example and that numerous changes in the details of discussion may be resorted to without departing from the spirit and scope of the invention. Thus, the scope of the invention should not be limited by the foregoing specification but rather only by the scope of the claims appended hereto.

What is claimed is:

1. A multivariant game apparatus adapted to be used for the play of different board games by 2 to 4 players comprising:

a game board having a rectangular coordinate gridded space system having rows and columns imprinted as playing surface adapted to be changed into the different playing patterns on which the various games are played wherein said gridded space system includes a grid type webbing secured above the playing field such that said webbing extends along the side of each grid space and separates the individual imprinted grid spaces from each other, said web acting to form shallow cavities for a tile to be placed on the grid space such that the tile cannot slide or slip out of the position;

a multiplicity of marked playing pieces adapted to be picked up at random and placed on said board according to the rules of the game being played; wherein said pieces are thin magnetizable tiles having one of a set of markings comprising letters, numbers, and suit markings commonly found on playing cards, said tiles further being made in such a size to fit into said webbing so that it rests in said cavities on said playing surface;

means to block off and segregate areas within the boundaries of the playing board to vary the board configuration for the particular game being played, said blocking means comprising tiles having indicia thereon denoting playing area boundaries and different from the markings on said playing piece tiles, said blocking tiles further being made in such a size to fit into said webbing so that they rest in said cavities on said playing surface;

container means for storing said tiles during the playing of the game wherein the container is a tall, can-like structure of such depth that when said playing pieces are placed therein, they cannot be seen by players of the game, and;

selection means comprising a magnet of such strength and size that it will generally pick up only one of said magnetized tiles, said selection means further being placed on a wand so that it may be inserted into said container means for the purposes of randomly selecting one of the playing pieces for the particular game being played.

* * * * *